US007492335B2

(12) United States Patent
Johnson

(10) Patent No.: US 7,492,335 B2
(45) Date of Patent: Feb. 17, 2009

(54) DISCHARGE OF A FIELD EMISSION DISPLAY BASED ON CHARGE ACCUMULATION

(75) Inventor: Scott V. Johnson, Scottsdale, AZ (US)

(73) Assignee: Motorola, Inc., Schaumburg, IL (US)

( * ) Notice: Subject to any disclaimer, the term of this patent is extended or adjusted under 35 U.S.C. 154(b) by 287 days.

(21) Appl. No.: 11/510,549

(22) Filed: Aug. 25, 2006

(65) Prior Publication Data

US 2008/0048570 A1 Feb. 28, 2008

(51) Int. Cl.
*G09G 3/10* (2006.01)

(52) U.S. Cl. ..... 345/75.2; 345/74.1

(58) Field of Classification Search ..... 315/169.3, 315/366; 313/495, 496, 421, 422; 345/75.2, 345/74.1

See application file for complete search history.

(56) References Cited

U.S. PATENT DOCUMENTS 5,859,508 A 1/1999 Ge et al.
6,031,336 A 2/2000 Rumbaugh
6,380,914 B1 4/2002 Xie
7,358,933 B2 * 4/2008 Cho ..... 345/74.1

OTHER PUBLICATIONS

International Search Report, PCT/US07/72734 dated Feb. 25, 2008.

* cited by examiner

*Primary Examiner*—David Hung Vu

(57) ABSTRACT

A field emission device (100) is provided for reducing power and audible noise during discharging of dielectric surfaces (137, 138). The field emission device (100) comprises an anode (122) and a first substrate (111) including a cathode plate (110) comprising a plurality of active display devices (114) and dielectric surfaces (137, 138). The plurality of active display devices (114) emit electrons (132) to strike the anode during a scanning mode, and emit electrons (135) to strike the dielectric surfaces (137, 138) during a discharge mode. At least one of a plurality of spacers (136) positioned between the anode (122) and the cathode plate (110) comprise a first sense electrode (142) positioned proximate to the anode (122), and a second sense electrode (144) positioned proximate to the cathode plate (110) and spaced apart from the first sense electrode (142). A circuit (222, 224, 226) for sensing a difference in charge between the first and second sense electrodes (142, 144) is coupled to the anode (122) and cathode plate (110) for alternately initiating the scanning mode and the discharge mode in response to the difference in charge reaching a threshold.

14 Claims, 3 Drawing Sheets

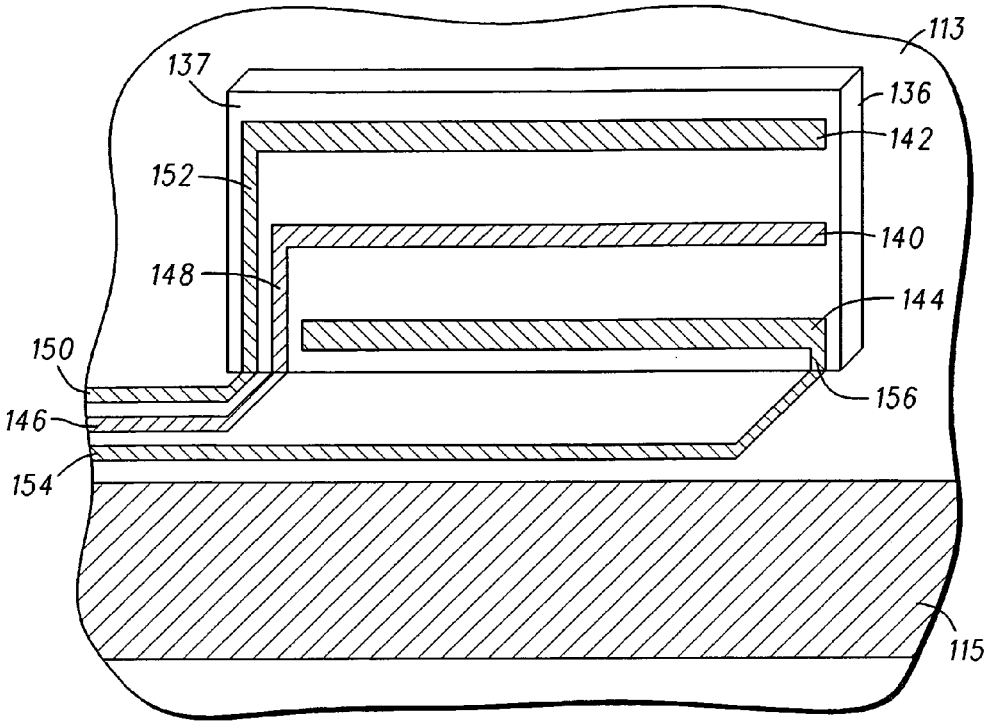
FIG. 2
FIG. 3
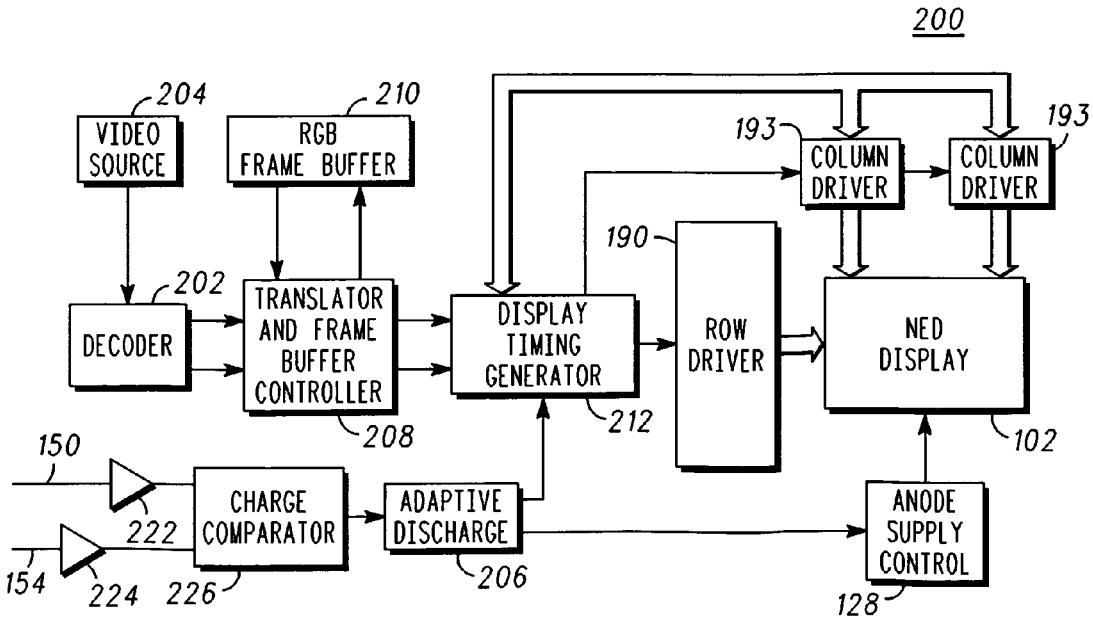

DISCHARGE OF A FIELD EMISSION DISPLAY BASED ON CHARGE ACCUMULATION

FIELD OF THE INVENTION

The present invention generally relates to field emission displays and more particularly to an apparatus for reducing power and audible noise by discharging of dielectric surfaces at intervals based on accumulated charge.

BACKGROUND OF THE INVENTION

Field emission displays are well known in the art. A field emission display includes an anode plate and a cathode plate that define a thin envelope. Typically, the anode plate and cathode plate are thin enough to necessitate some form of a spacer structure to prevent implosion of the device due to the pressure differential between the internal vacuum and external atmospheric pressure. The spacers are disposed within the active area of the device, which includes the electron emitters and phosphors.

The potential difference between the anode plate and the cathode plate is typically within a range of 300-10,000 volts. To withstand the potential difference between the anode plate and the cathode plate, the spacers typically comprise a dielectric material. Thus, the spacers have dielectric surfaces that are exposed to the evacuated interior of the device.

During the operation of the field emission display, electrons are emitted from the electron emitters, such as Spindt tips or carbon nanotubes, toward the anode plate. These electrons traverse the evacuated region and impinge upon phosphors positioned on the anode plate; however, some of these electrons may strike the dielectric surfaces of the spacers. In this manner, the dielectric surfaces of the spacers become charged. Typically, the dielectric spacers become positively charged because the secondary electron yield of the spacer material is initially greater than one.

Numerous problems arise due to the charging of the dielectric surfaces within a field emission display. For example, control over the trajectory of electrons adjacent to the spacers is lost. Also, the risk of electrical arcing events increases dramatically.

It is known to use electron current from the electron emitters coupled with a fixed resistance connected between the anode plate and an anode voltage source to reduce the voltage at the anode plate and cause the electrons to be attracted by the charged surfaces instead of the anode. The electrons are used to neutralize the charged surfaces. However, the electrons that bounce off of or emit secondarily from the dielectric surface also strike the phosphors, which results in a visible "flash" of light being generated at the viewing screen of the field emission display. Furthermore, the fixed resistance between the anode plate and the anode voltage source necessitates a high current to pull down the anode voltage, which results in large power losses. Conventionally, this discharge is accomplished every frame, resulting in a high current drain and a perceptive "buzz".

U.S. Pat. No. 6,031,336 disclosed a pull-down circuit integrated on a substrate separate from the substrate containing electron emitters for illuminating the display screen. This patent taught a method of reducing charge accumulation in a field emission display, thereby reducing or eliminating a visible "flash" and reducing the power loss associated with pulling down the anode voltage.

Accordingly, there exists a need for a method for reducing charge accumulation in a field emission display, which reduces or eliminates this visible "flash" and which reduces the power loss associated with repetitively pulling down the anode voltage. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A field emission device reduces power and audible noise during discharging of dielectric surfaces. The field emission device comprises an anode and a first substrate including a cathode plate comprising a plurality of active display devices and dielectric surfaces. A plurality of spacers comprising additional dielectric surfaces is positioned between the anode and the cathode plate to insure physical separation. The plurality of active display devices emit electrons to strike the anode during a scanning mode, and emit electrons to strike the dielectric surfaces during a discharge mode. At least one of the plurality of spacers comprise a first sense electrode positioned proximate to the anode, and a second sense electrode positioned proximate to the cathode plate and spaced apart from the first sense electrode. A circuit for sensing a difference in charge between the first and second sense electrodes is coupled to the anode and cathode plate for alternatingly initiating the scanning mode and the discharge mode in response to the difference in charge reaching a threshold.

BRIEF DESCRIPTION OF THE DRAWINGS

The present invention will hereinafter be described in conjunction with the following drawing figures, wherein like numerals denote like elements.

FIG. 2 is a perspective view of a spacer within the field emission display in accordance with an exemplary embodiment;

FIG. 3 is a block diagram of a field emission display device in accordance with an exemplary embodiment.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A potential on an anode of a field emission display is discharged when needed (discharge mode) in order to neutralize a positive charge on dielectric surfaces within the field emission display by directing a large number of electrons from electron emitters at the dielectric surfaces. The rate and frequency of discharge of the anode is based on an accumulated charge measured between the anode and cathode during the normal scanning (display) mode, thereby reducing the number of discharge cycles per unit time, providing for higher efficiency and lower audible noise when compared with the conventional method of discharging between each scanning frame.

A field emission display comprises an anode voltage pull-down circuit that discharges the anode for allowing emitted electrons from the device to discharge electrostatically charged dielectric surfaces within the display device, including spacers.

Preferably, the anode voltage pull-down circuit provides the benefit of reducing or eliminating an electron current that activates the phosphors during the step of reducing the anode voltage. This reduces power dissipation associated with reducing the anode voltage and provides the benefit of avoiding generation of an undesirable, visible "flash". Due to the rapid discharge, the wave shape can be tailored to reduce audible noise. The anode voltage pull-down circuit is particularly useful for anode scanning potentials of greater than 600 volts, preferably greater than 1000 volts, and most preferably greater than 3000 volts.

The method for operating a field emission display in accordance with the invention includes, when the charge within the field emission display reaches a threshold, the steps of reducing a potential at the anode and, thereafter, causing a discharge current to be emitted from the electron emitters of the display device. The discharge current is useful for neutralizing positively electrostatically charged surfaces within the display device. This avoids generation of a visible "flash" from the display during the step of reducing the anode potential. Furthermore, the step of reducing the anode potential is preferably controlled in order to control the response of the display device and/or the anode power supply.

Figure 1:
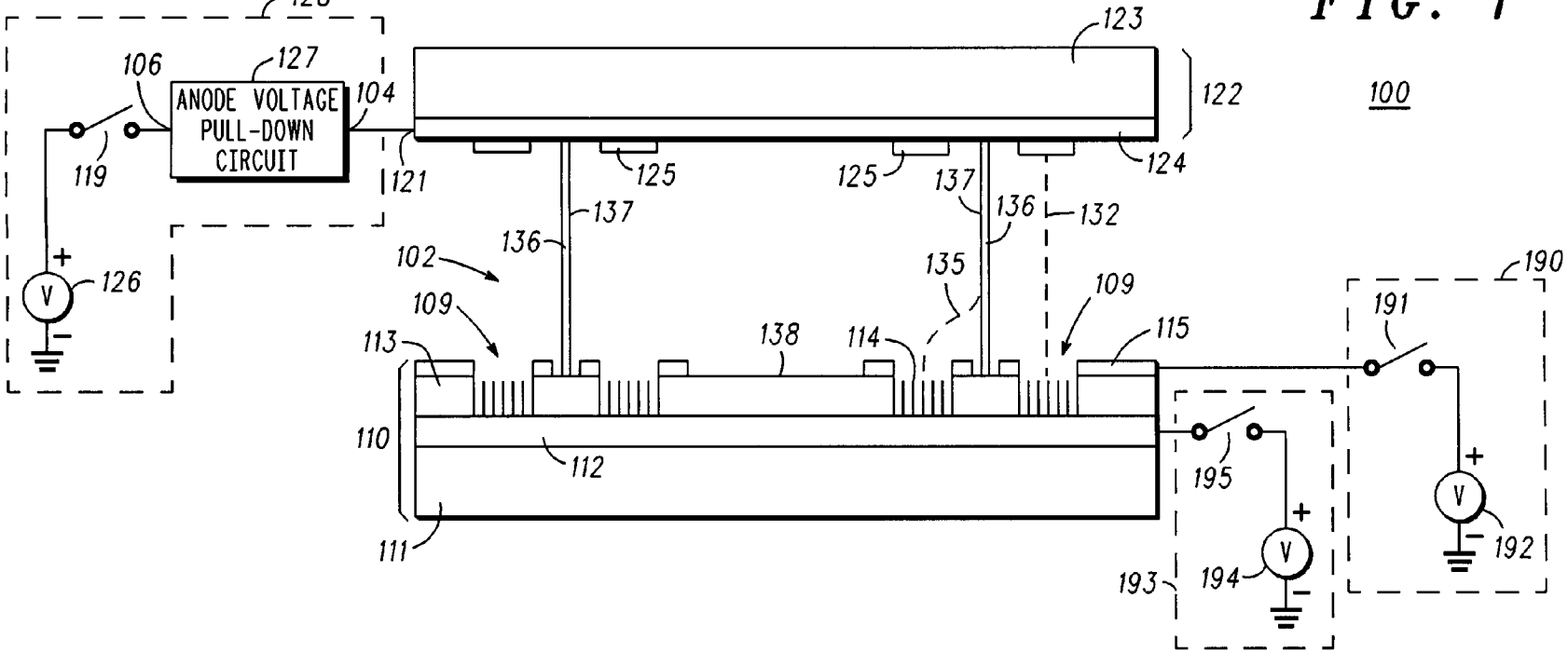
FIG. 1 is a cross-sectional view of a field emission display that may be used with an exemplary embodiment.

FIG. 1 is a cross-sectional view of a field emission display 100 in accordance with an exemplary embodiment. Field emission display 100 includes a display device 102 and an anode supply control 128. Display device 102 includes a cathode plate 110 and an anode plate 122. Cathode plate 110 and anode plate 122 are spaced apart by spacers 136. Cathode plate 110 includes a substrate 111, which can be made from glass or silicon, for example. A plurality of conductive columns 112 is disposed upon substrate 111. A dielectric layer 113 is disposed upon conductive columns 112 and further patterned to define a plurality of wells 109.

One or more electron emitters 114 are disposed in each of the wells 109. Anode plate 122 is disposed to receive an electron current 132 emitted by electron emitters 114. The electron emitters 114 may comprise any known emitters, e.g., Spindt tips or carbon nanotubes. A plurality of conductive rows 115 (emitter gate) are formed on dielectric layer 113 proximate to the wells 109. Conductive columns 112 and conductive rows 115 are used to selectively address electron emitters 114.

To facilitate understanding, FIG. 1 depicts only a four rows and one column within the active device 102. However, it is desired to be understood that any number of rows and columns can be employed. An exemplary number of rows for display device 102 is 240, and an exemplary number of columns is 720. Methods for fabricating cathode plates for matrix-addressable field emission displays typically comprise known lithographic techniques.

Anode plate 122 includes a transparent substrate 123 made from, for example, glass. An anode 124 is disposed on transparent substrate 123. Anode 124 is preferably made from a transparent conductive material, such as indium tin oxide. In the exemplary embodiment, anode 124 is a continuous layer that opposes the entire emissive area of cathode plate 110. That is, anode 124 opposes the entirety of electron emitters 114 of the active display device 102. Anode 124 is designed to be connected to a potential source 126, which is preferably a direct current voltage source, in a manner to be discussed hereinafter. A plurality of phosphors 125 is disposed upon anode 124 within the active display device 102. Methods for fabricating anode plates for matrix-addressable field emission displays are also known to one of ordinary skill in the art.

An output 104 of anode voltage pull-down circuit 127 is connected to an input 121 of anode 124. An input 106 of anode voltage pull-down circuit 127 is designed to be coupled to potential source 126 by circuitry represented by a switch 119.

Spacers 136 are useful for maintaining a separation distance between cathode plate 110 and anode plate 122. Only two spacers 136 are depicted in FIG. 1; however, the actual number of spacers 136 depends on the structural requirements of display device 102. Spacers 136 may be made from a dielectric material, a bulk resistive material, or a combination thereof, for example. Spacers 136 may be thin plates, ribs, or any of numerous other shapes. The spacers 136 typically have the dimensions of 700-3,000 microns high and 150-700 microns by 3,000 microns cross section. Any dielectric surface defined by spacer 136 can become a positively electrostatically charged surface 137 during the operation of field emission display 100. Other surfaces, such as a surface 138 of dielectric layer 113 can also become positively electrostatically charged during operation of the device. These surfaces become charged because some of the electrons of electron current 132 impinge upon gas molecules that become positively ionized and impact these surfaces. If a surface has a secondary electron yield of greater than one, the surface emits more than one electron for each electron or ion received. Thus, a positive potential is developed. The method of the invention described herein is useful for reducing the charge on these surfaces, while simultaneously improving power requirements, black level, and response of potential source 126 during the steps for reducing the charge.

A voltage source 194 is connected to each of conductive columns 112 by circuitry represented by switch 195. Voltage source 194 is useful for applying potentials, as defined by video data, for creating a display image and for reducing charge accumulation in display device 102. A voltage source 192 is connected to each of conductive rows 115 by circuitry represented by switch 191. Voltage source 192 is useful for applying potentials for creating a display image and for reducing charge accumulation in display device 102.

It should be understood that the field emission display 100 shown is only one of many displays that may be used with the exemplary embodiment described below.

Referring to FIG. 2 and in accordance with the exemplary embodiment, one or more of the plurality of spacers 136 comprise a guard electrode 140 positioned between first and second sense electrodes 142 and 144 on the surface 137. The guard electrode 140 is coupled to conductive layer 146 by conductive tracing 148. The sense electrode 142 is coupled to conductive layer 150 by conductive tracing 152, and the sense electrode 144 is coupled to conductive layer 154 by conductive tracing 156. The guard electrode 140, first and second sense electrodes 142, 144, and conductive tracings 148, 152, 156 are electroplated on the surface 137 of the spacer 136. The conductive layers 146, 150, 154 are lithographically formed in the dielectric layer 113. The guard electrode 140, first and second sense electrodes 142, 144, conductive tracings 148, 152, 156, and conductive layers 146, 150, 154 may comprise any conductive material, but preferably comprise a metal such as gold. The distance between the sense electrodes 142 and 144 preferably is about a third of the length of the spacer 136, but may comprise any distance up to almost the length of the spacer 136, but must be spaced apart far enough to prevent electrons from migrating therebetween. The optional guard electrode 140, which is coupled to a voltage potential, reduces the likelihood of this electron migration, which would disturb the charge accumulation and invalidate the measurement. Spacers including the sense electrodes 142, 144 preferably comprise the same dielectric material as the other spacers 136, differing only in the metallization for the electrodes, which may be deposited using conventional semiconductor physical vapor deposition processes.

The operation of field emission display 100 is characterized by two modes of operation: a scanning mode and a discharge mode. During the scanning mode, potentials are sequentially applied to conductive rows 115. By scanning it is meant that a potential suitable for causing electron emission is selectively applied to the scanned row. Whether each of electron emitters 114 within a scanned row is caused to emit electrons depends upon the video data and the voltage applied to each column. Electron emitters 114 in the rows not being scanned are not caused to emit electrons. During the time that one of conductive rows 115 is scanned, potentials are applied to conductive columns 112 according to video data.

During the scanning mode, an anode voltage 120 (Va) which is the potential at anode 124, is selected to attract electron current 132 toward anode plate 122 and to provide a desired level of brightness of the image generated by phosphors 125. Anode voltage 120 is provided by potential source 126. During the scanning mode, anode voltage 120 is held at some value which is preferably greater than 600 volts, more preferably greater than 1000 volts, and most preferably greater than 3000 volts.

During the scanning mode, most of the electrons emitted by electron emitters 114 strike anode plate 122. However, some of the emitted electrons impinge upon dielectric surfaces such as emitter wall 137 and surface 138 within active display device 102, causing the dielectric surfaces to become positively electrostatically charged. The charged surfaces cause undesirable effects, such as adversely affecting the control of electron current 132 and possibly undesired arching events.

To achieve the discharge mode of operation of field emission display 100, anode voltage 120 is reduced from a scanning mode value to a discharge mode value, and electron current 132 is increased from a scanning mode value to a discharge mode value. The discharge mode value of electron current 132 is useful for neutralizing positively electrostatically charged surfaces within display device 102. Anode voltage 120 is reduced by an amount sufficient to allow electron current 135 to be directed toward the charged surfaces 137, 138. Preferably, anode voltage 120 is reduced to about ground potential. Anode voltage pull-down circuit 127 is useful for reducing anode voltage 120 during the discharge mode of operation.

The discharge current is preferably generated by causing the entirety of electron emitters 114 to emit electrons. This is achieved by applying the appropriate emission/"on" potentials to all of rows 115 and columns 112 of cathode plate 110. Thus, the discharge current available for neutralization is equal to the product of the total number of rows 115 and the maximum emission current per row 115. The discharge current can also be generated by causing less than all of electron emitters 114 to emit electrons.

Referring to FIG. 3, a block diagram of the control circuitry 200 for the field emission display 102 includes a decoder 202 responsive to a video source 204 for decoding video images received electronically. The decoder 202 comprises a microprocessor and memory for analyzing the video image (data bitstream) and provides data to the translator and frame buffer controller 208 for scaling and image and color correction. RGB (red, green, blue) frame buffer 210 serves to hold additional frames in memory for further processing. The programmable logic device display timing generator 212 controls the timing of current applied to the column drivers 214 and row driver 216. The charge appearing on sense electrodes 142 and 144 (FIG. 2) are supplied via conductive layers 150 and 154, respectively, to electrometer amplifiers 222 and 224. The signals from electrometer amplifiers 222, 224 are supplied to charge comparator 226, wherein the signals are compared and supplied to adaptive discharge 206. The adaptive discharge 206 supplies the anode supply control 127 which determines the state of switch 119 (see FIG. 1), and supplies the display timing generator 212 which determines the state of row driver 190 including switch 191 and column driver 193 including switch 195 (see FIG. 1).

Figure 4:
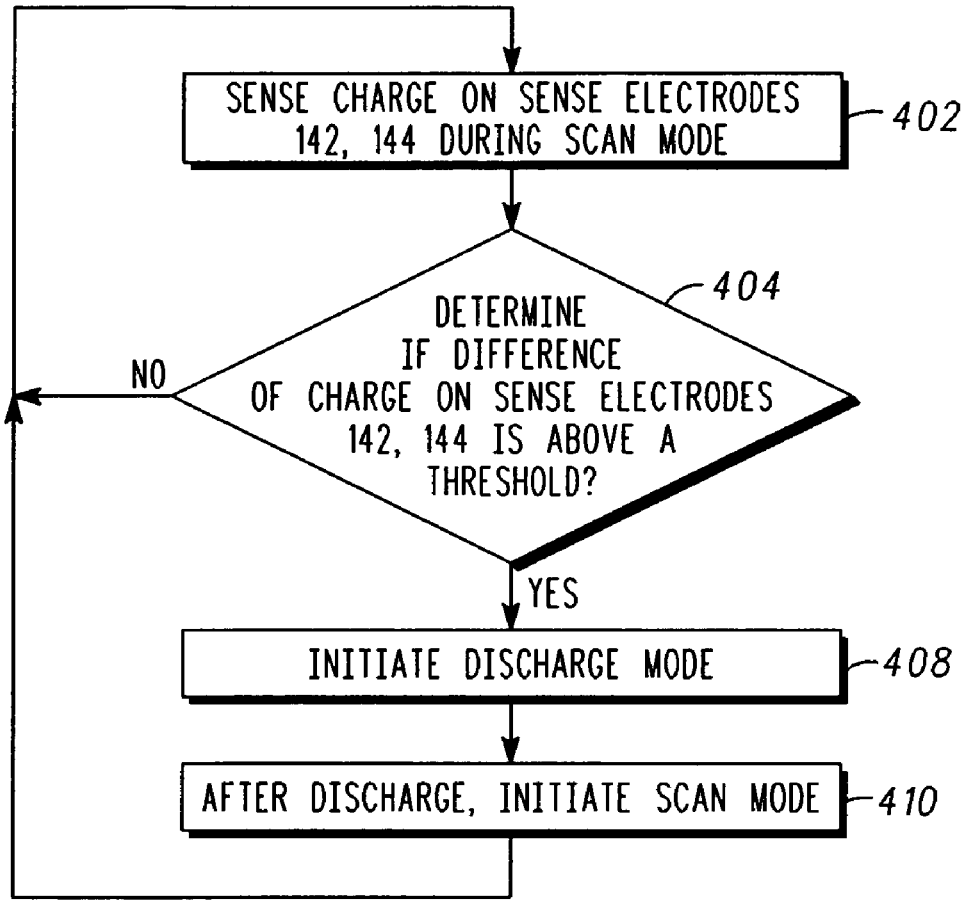
FIG. 4 is flow chart of steps of a first exemplary embodiment.

Referring to FIG. 4, the flow chart 400 of the program in the decoder 202 illustrates the process of the exemplary embodiment and includes the steps of sensing 402 the charge on the sense electrodes 142, 144 during a scan mode. A determination 404 is made if the difference in charge between electrodes 142, 144 is above a threshold. If no, the charge on the sense electrodes 142, 144 is again sensed 402. If yes, the discharge mode of the cell 100 is initiated by reducing the anode voltage and increasing the emitter current. Once the dielectric surfaces are discharged, the scan mode is again initiated.

The threshold would best be determined by physically viewing the display during manufacturing testing and setting the threshold at a value where the spacers are invisible (no bright or dark areas in the vicinity of the spacers). The charge level would be measured and fed into a comparator, which could be adjusted to dynamically compensate for variables such as anode voltage, gate voltage, etc., all of which would affect the level of charging.

In summary, the invention is for a field emission display having an anode voltage pull-down circuit connected to the anode of the field emission display. The anode voltage pull-down circuit has a discharge mode configuration, which is employed to reduce the potential at the anode. Preferably, the anode voltage pull-down circuit provides the benefit of reducing or eliminating activation of the phosphors during the step of reducing the anode voltage. The preferred method for operating a field emission display in accordance with the invention includes, when the charge within the field emission display reaches a threshold, the steps of reducing a potential at the anode and, thereafter, causing a discharge current to be emitted from the electron emitters for neutralizing positively electrostatically charged surfaces within the field emission display. The field emission display and method of the exemplary embodiment provide numerous benefits, such as improved power requirements, improved black level of the display device, and improved control over the response of the anode power supply and of the display plates to a reduction in anode voltage.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A field emission device comprising:

an anode;

a first substrate including a cathode plate comprising a plurality of active display devices and dielectric surfaces;

a plurality of spacers positioned between the anode and the cathode plate and also comprising dielectric surfaces, at least one of the plurality of spacers comprising:

a first sense electrode positioned proximate to the anode; and a second sense electrode positioned proximate to the cathode plate and spaced apart from the first sense electrode; and a circuit for sensing a difference in electrostatic charge between the first and second sense electrodes and coupled to the anode and cathode plate for alternatingly initiating a scanning mode and a discharge mode in response to the difference in electrostatic charge, wherein the plurality of active display devices emit electrons to strike the anode during a scanning mode, and emit electrons to strike the dielectric surfaces during a discharge mode.

2. The field emission device of claim 1 wherein the at least one of the plurality of spacers comprises a surface having the first and second sense electrodes deposited thereon.

3. The field emission device of claim 1 wherein the first and second sense electrodes comprise gold.

4. The field emission device of claim 1 further comprising a guard electrode positioned between the first and second sense electrode.

5. The field emission device of claim 1 wherein the guard electrode comprises gold.

6. A field emission device comprising:

a first substrate comprising:

a cathode plate comprising:

a cathode adapted to be coupled to a first voltage;

a plurality of electron emitters positioned on the cathode; and a gate positioned near the plurality of electron emitters and adapted to be coupled to a second voltage;

an anode plate adapted to be coupled to a second voltage and positioned to receive electrons from the plurality of electron emitter devices during a scanning mode;

an anode pull down circuit for reducing the second voltage during a discharge mode;

a display timing generator for determining when the first voltage is applied;

a plurality of spacers positioned between and separating the cathode plate and the anode plate, and positioned to receive electrons from the plurality of electron emitter devices during the discharge mode, at least one of the plurality of spacers comprising:

a first sense electrode positioned proximate to the anode; and a second sense electrode positioned proximate to the cathode plate and spaced apart from the first sense electrode; and a circuit for sensing a difference in electrostatic charge between the first and second sense electrodes and coupled to the anode pull down circuit and the display timing generator for alternatingly initiating the scanning mode and the discharge mode in response to the difference in electrostatic charge.

7. The field emission device of claim 6 wherein the first and second sense electrodes comprise gold.

8. The field emission device of claim 6 further comprising a guard electrode positioned between the first and second sense electrode.

9. The field emission device of claim 6 wherein the guard electrode comprises gold.

10. A method for discharging electrostatic charged dielectric surfaces of a field emission display, comprising the steps in sequence:

(a) determining a difference in electrostatic charge within the field emission display;

(b) if the difference exceeds a threshold:

lowering the voltage on an anode; and impacting electrons from a plurality of emitters upon the dielectric surfaces.

11. The method of claim 10 wherein the lowering of the voltage comprises lowering the voltage an amount determined by the amount of electrostatic charge.

12. The method of claim 10 wherein the impacting step comprises impacting electrons upon the dielectric surfaces only when the threshold is reached.

13. The method of claim 10 wherein the determining step comprises determining a difference in electrostatic charge between two sense electrodes positioned on a spacer positioned between a cathode plate and an anode of the field emission display.

14. The method of claim 13 further comprising preventing electrons from migrating between the two sense electrodes.

* * * * *

UNITED STATES PATENT AND TRADEMARK OFFICE

CERTIFICATE OF CORRECTION

PATENT NO. : 7,492,335 B2
APPLICATION NO. : 11/510549
DATED : February 17, 2009
INVENTOR(S) : Scott V. Johnson It is certified that error appears in the above-identified patent and that said Letters Patent is hereby corrected as shown below:

IN THE SPECIFICATION

In Column 4, Line 17, delete "3,000" and insert -- 3,000-10,000 --, therefor.

Signed and Sealed this

Eleventh Day of August, 2009

David J. Kappos

David J. Kappos
*Director of the United States Patent and Trademark Office*